United States Patent [19]

Anderson

[11] Patent Number: 5,011,006

[45] Date of Patent: Apr. 30, 1991

[54] CONTAINER WITH LID CLOSURE HAVING AN IMPROVED FLARED STAND FEATURE

[75] Inventor: David S. Anderson, Brooklyn Park, Minn.

[73] Assignee: General Mills, Inc., Minneapolis, Minn.

[21] Appl. No.: 515,012

[22] Filed: Apr. 26, 1990

Related U.S. Application Data

[63] Continuation-in-part of Ser. No. 509,658, Apr. 16, 1990, which is a continuation-in-part of Ser. No. 418,425, Oct. 6, 1989, Pat. No. 4,962,849.

[51] Int. Cl.[5] ..... B65D 5/52

[52] U.S. Cl. ..... 206/45.24; 206/45.23; 206/45.18; 229/125.35

[58] Field of Search ..... 206/45.18, 45.23, 45.24, 206/470, 557, 601, 620, 629, 631, 633, 467; 229/125.35

[56] References Cited

U.S. PATENT DOCUMENTS

| | | | |
|---|---|---|---|
| 2,973,086 | 2/1961 | Thompson | 206/633 |
| 3,349,985 | 10/1967 | Salway | 206/557 |
| 3,371,848 | 3/1968 | Ward et al. | 206/631 |
| 3,434,651 | 3/1969 | Stec | 206/633 |
| 3,495,758 | 2/1970 | Wienecke Jr. | 229/125.35 |
| 3,495,759 | 2/1970 | Bergstrom et al. | 206/633 |
| 3,615,707 | 10/1971 | Filz | 206/629 |
| 3,717,533 | 2/1973 | Mayworm et al. | 206/633 |
| 3,730,338 | 5/1973 | Chesky | 206/557 |
| 4,091,930 | 5/1978 | Buchner et al. | 206/633 |
| 4,236,637 | 12/1980 | Castner, Sr. et al. | 206/470 |
| 4,568,017 | 2/1986 | Grunert | 206/45.24 |
| 4,702,368 | 10/1987 | Jones | 206/45.24 |
| 4,784,268 | 11/1988 | Perchak | 206/470 |
| 4,880,112 | 11/1989 | Conrad | 206/457 |
| 4,930,627 | 6/1990 | Borst et al. | 206/470 |
| 4,962,849 | 10/1990 | Anderson | 206/45.24 |

FOREIGN PATENT DOCUMENTS

| | | | |
|---|---|---|---|
| 613023 | 2/1961 | Canada | 206/633 |
| 2127677 | 4/1984 | United Kingdom | 206/557 |

*Primary Examiner*—David T. Fidei
*Attorney, Agent, or Firm*—John A. O'Toole

[57] ABSTRACT

Disclosed are containers having an improved flared stand feature comprising a tray having a major open end and a defined lid closure for the open end providing the stand feature. The stand feature allows the tray to stand vertically on a sidewall thereby allowing presentation of the package with the lid towards the viewer. The flared stand provides greater lateral stability. The container finds particular suitability for use as a food container for packaged food items, both frozen and shelf stable. The stand feature allows the package to be fabricated without the conventional outer carton or outer shrink wrap film. Also disclosed are package flats for lids having a defined stand forming tab which lids are suitable for use as a closure for trays so as to provide the trays with the present side stands feature.

22 Claims, 6 Drawing Sheets

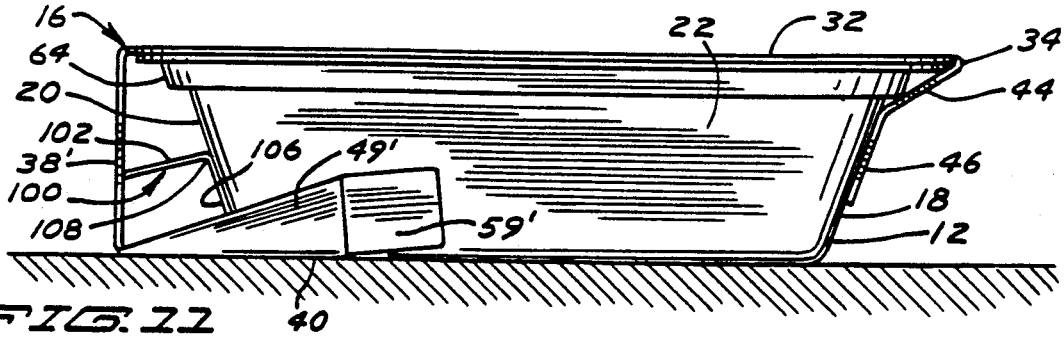
FIG. 11
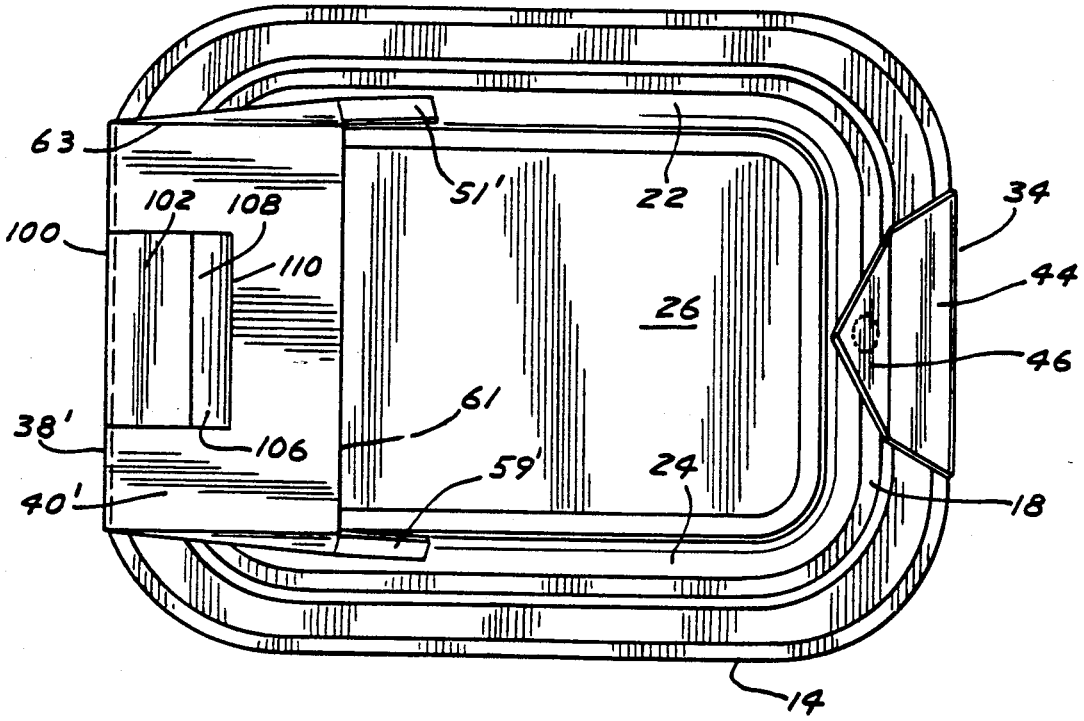
FIG. 12
FIG. 13
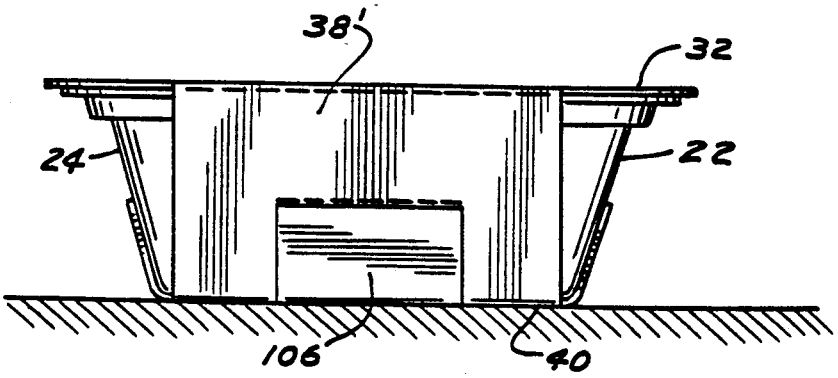

CONTAINER WITH LID CLOSURE HAVING AN IMPROVED FLARED STAND FEATURE

CROSS REFERENCE TO RELATED APPLICATIONS

This is a continuation-in-part application to U.S. Ser. No. 509,658, filed Apr. 16, 1990 by David S. Anderson et al. entitled CONTAINER WITH LID CLOSURE HAVING A FLARED STAND FEATURE, which in turn is a continuation-in-part application to U.S. Ser. No. 418, 425, filed Oct. 6, 1989 by David S. Anderson entitled FOOD CONTAINER WITH LID CLOSURE HAVING A STAND FEATURE, now U.S. Pat. No. 4,962,849 issued Oct. 16, 1990.

FIELD OF THE INVENTION

The present invention relates to containers, to lid closures therefor and to lid closure blanks. More particularly, the present invention provides containers comprising a tray and a particular lid closure for use such as for packaged foods and having a stand which is adapted to support the tray in a vertical position standing on one tray sidewall.

BACKGROUND OF THE INVENTION

Containers for a wide variety of food products comprise a tray housing a food portion and having a lid closure sealed to the tray. Such food products may be distributed frozen or may be dry or, if wet, aseptically processed for distribution at room temperature.

More recently, food products adapted to be microwave heated have become especially popular. Frequently, such containers are constructed having a membrane closure sealed to the tray with a removably detachable perforated lid. The consumer removes the lid and membrane seal, replaces the lid and microwave heats the food product. The replaced lid functions as a splatter guard during the microwave heating step. The perforations allow for steam release during the heating step.

While convenient and practical, such containers are most invariably housed within an outer carton or box and often additionally comprise a shrink wrap film to provide a tamper evident feature and/or to hold the package elements together. The outer carton is typically rectangular and is often adapted to stand on one minor side so as to present a major face outward to the consumer. The outer carton's major face contains graphics and print information designed to attract and appeal to consumers.

While manifestly desirable from a sales standpoint, the outer carton and shrink wrap film elements represent a considerable cost to the overage package system. Moreover, the carton is oftentimes negatively perceived by the consumer as costly and wasteful excess packaging material. Accordingly, it would be desirable to fabricate containers which allow for standing on one minor side to present a major face, e.g., the lid, to the consumer/viewer. Such a construction would allow the graphics to be presented on the lid which comprises the major face. Such a construction would provide the benefit of eliminating the need for the additional external cardboard box housing the container.

While the need for such a container and the advantages to be derived therefrom are clear, the satisfaction of this need is maddeningly complex. The container design necessarily must provide the necessary support.

The support must be of sufficient strength to support typical loads occasioned by conventional stacking arrangements. The structure must be easy to open. The structure must comprise elements which themselves are easy to manufacture and to assemble. The package must also stack on its major surfaces during distribution to the food retailer in conventional multiple unit case packing. The package desirably is tamper evident, i.e., the consumer can determine from visual inspection that the container seal integrity has not been compromised. Of course, each package element is desirably low in cost while highly functional.

Surprisingly, the present invention provides a container design which meets each of these requirements and therefore satisfies the need for an improved food container having a stand feature. The present invention resides in part in a specially defined lid flat adapted to be used as a closure for conventional trays which lid includes a novel stand/support feature.

The present invention resides in further improvements to the container disclosed in the parent applications. In the parent applications, the improvements reside in the structure of the stand feature having a flared base which provides an improved stand. In the present invention, further improvements in the stand are disclosed. In one respect, the present improvement resides in the provision of a brace feature. The brace feature does not positioning or indexing of the tray in the stand during industrial production. This proper positioning of the tray helps insure that the panel members are at right angles so that the base panel is more closely exactly horizontal. Such construction provides benefits in forward to back stability.

In another aspect, the present improvements reside in a stand feature of improved appearance, namely, a rectangular base but nonetheless having lateral support panels affixed to the tray vertical sidewalls and having the brace feature.

BRIEF DESCRIPTION OF THE DRAWINGS

FIG. 11 is a side view of the second container embodiment similar to FIG. 4;

FIG. 12 is a bottom view of the second container embodiment similar to FIG. 5;

FIG. 13 is an end view of the second container embodiment similar to FIG. 6;

FIG. 14 is a perspective view of the second container embodiment showing the lid in an open position after unsealing the container; and FIG. 15 is a plan view of the inner surface of a blank for forming the second container lid embodiment.

The foregoing briefly described drawings are for illustrative purposes only and should not be construed to limit the claims.

DESCRIPTION OF THE PREFERRED EMBODIMENTS

Figure 1:
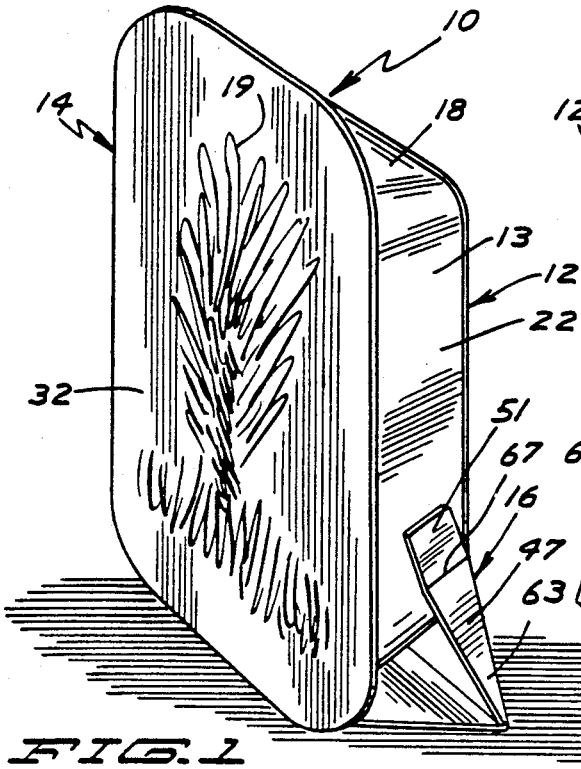
FIG. 1 is a perspective view of an embodiment of the present container presenting the lid or container front face partially to the viewer.

Referring now to the drawings, and in particular to FIG. 1, there is shown an embodiment of the present food container designated generally by reference numeral 10 having as a distinctive feature an improved end stand 16. The container 10 can be of any conventional shape depending upon the size, number, and shape of the food items being packaged. If desired, the article 10 can optionally include a conventional overwrap or wrapper, (not shown) closely conforming to the shape of the container described below and substantially surrounding and sealing the article. The material from which the overwrap is fabricated can be any conventional packaging material for frozen or shelf stable food items, such as a plastic film or heat oriented polyolefin copolymer having a thickness of about 0.0005 to 0.002 inch. However, it is an advantage of the present container that such conventional overwrap can be eliminated without sacrificing a tamper evidencing feature as described more fully below. More importantly, the present container 10 desirably avoids a conventional expensive outer box or carton.

In FIG. 1, it can be seen that the container 10 essentially comprises a tray 12 for supporting the item(s) to be packaged and a novel closure lid 14 therefor. The tray 12 is conventional in design, shape and size and can conveniently be constructed or fabricated from plastic, metal, ceramics, or, preferably, pressed paper. The rectangular tray 12 depicted comprises a continuous sidewall 13 including an opposed pair of minor sides including upper minor side 18 as well as the lower or bottom minor side 20 (not shown) and an opposed pair of major sides 22 and 24 (see FIG. 2). Now referring briefly to FIG. 2, it can be seen that the tray 12 additionally includes a rear major surface 26 and an opposed major open face or orifice 27. The tray can be of any regular or complex shape. Useful regular shapes, of course, include both those trays which are continuously curved (e.g., ovals or circles) or, preferably, having at least one straight side (e.g., squares, triangles, rectangles, half circles).

FIG. 1 also shows that the lid 14 overlays the tray open face 27 and thus comprises a removably sealed closure therefor. The lid 14 includes a major face portion or lid panel 32 which conforms to the shape of the open face 27. The lid 14, and especially the lid face panel 32, can conveniently be printed with a variety of graphic material 19 such as pictures, prints, trademarks, directions, nutritional information, etc. Such graphics are conventionally employed on the outer container of a packaged food item.

Referring once again to FIG. 2, it can be seen that the container 10 includes, and the lid 14 additionally comprises, a means for supporting the tray 12 in a vertical position such as the improved, flared tab stand feature 16. The stand or tray supporting means provides the ability for the tray 12 to rest on a sidewall especially on a retail shelf so as to present forwardly the lid panel 32 and its graphics 19 to a potential viewer/consumer. Importantly, the stand 16 provides stability both side to side as well as forward and backward and sufficient vertical support to support the filled container's weight even after repeated handling. The present flared stand provides greater lateral stability.

Figure 2:
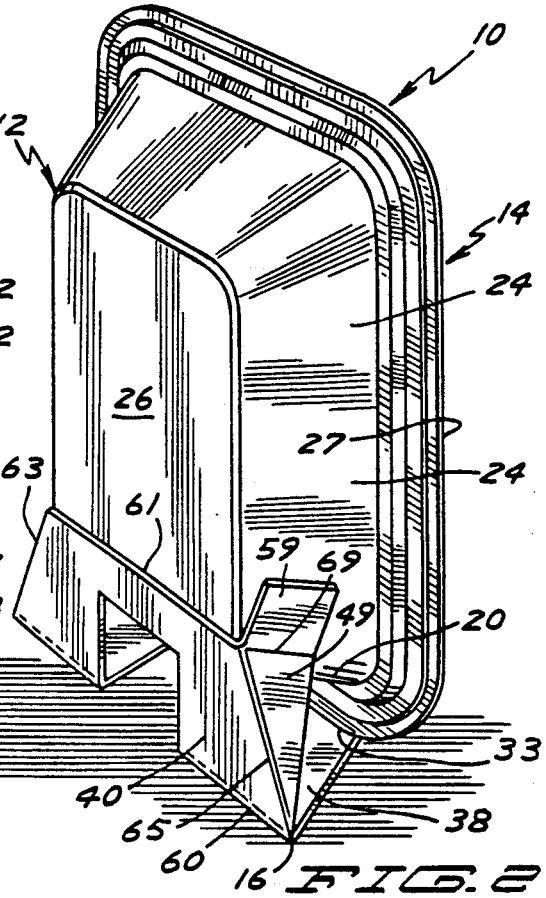
FIG. 2 is a perspective view of the container showing its rear face.

As shown in both FIGS. 1 and 2, the container stand feature 16 is integral to the lid 14 and is hingedly attached along a common first, transverse fold line 33. In FIG. 2, it is shown that in the embodiment 10, the stand feature 16 can include a trapezoidal base panel 38, a trapezoidal rear panel 40, an opposed pair of side vertical support panels 47 and 49 each of which in turn have stick tabs 51 and 59 affixed to tray sidewall 22 and 24 respectively. Rear panel 40 and base panel 38 are each defined in part by and foldably joined by or hingedly connected along a second common transverse fold line 60. Rear panel 40 is further defined by a transverse free edge 61 which abuts the tray rear face 26. The rear panel 40 has a first common, non-parallel or angled fold line 63 (see FIG. 1) which foldably adjoins the support panel 47 and a second common fold non-parallel or angled line 65 which foldably adjoins the support panel 49. Support panel 47 in turn has, and is defined in part by, a common fold line 67 along which stick tab 51 is foldably joined thereto. Similarly, (see FIG. 2 again) support panel 49 has, and is defined in part by, a common fold line 69 along which stick tab 59 is foldably joined thereto.

Figure 3:
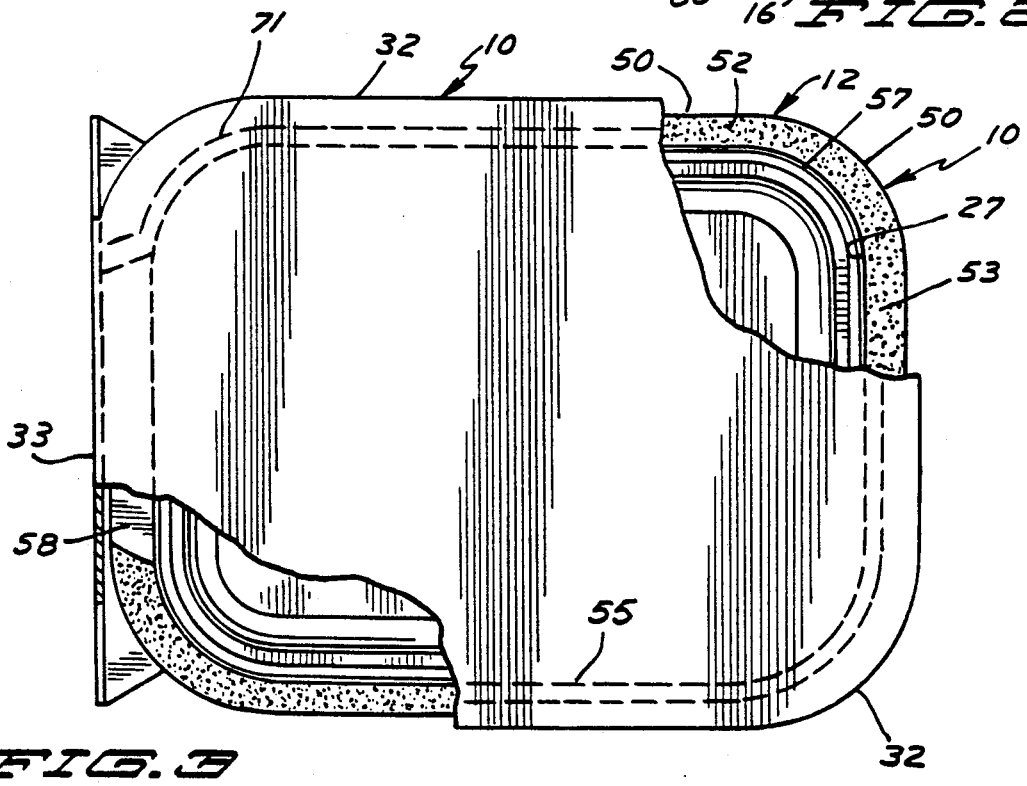
FIG. 3 is a top view of the container with the lid partially cut away.

Referring now to FIG. 3, it can be seen that the particular tray 12 depicted additionally includes, and the tray sidewall 13 is fabricated with, a top surface edge preferably widened such as a flange 50 depicted having an inner edge 57 extending completely around the periphery of the open face 27. FIG. 3 further shows that the lid major face 32 can have rounded corners so as to conform to the configuration of the tray 12 which can have rounded corners or in minor variations, sharp corners Still referring to FIG. 3, it can be seen that the container 10, specifically, the controlled opening means, additionally comprises a means for removably adhering the major face portion 32 of the lid 14 to the flange 50, such adhesion means being, for example, a heat activated adhesive 52 or preferably a conventional topically applied plastic coating applied to the inner surface of the lid 14 for hot melt sealing. If an adhesive is employed, the adhesive is applied to substantially all of the flange 50 to define a flange adhesive area 53 so as to provide a hermetic seal. However, in certain embodiments not requiring a hermetic seal, e.g., where the container houses dry mixes, the means for controllably opening the container can additionally include a flange adhesive free portion or area 58 underlying the lid 14 proximate the fold line 33 which remains unsealed.

FIG. 3 further shows that in preferred embodiments, the lid 14 can be fabricated with, and the controlled opening means can further comprise, a "reverse cut" pattern on the lid panel 32 comprising a first outer peripheral score line 71 on the outer lid panel surface 73. The outer score line 71 is positioned proximately above the inner edge of flange 57.

Figure 7:
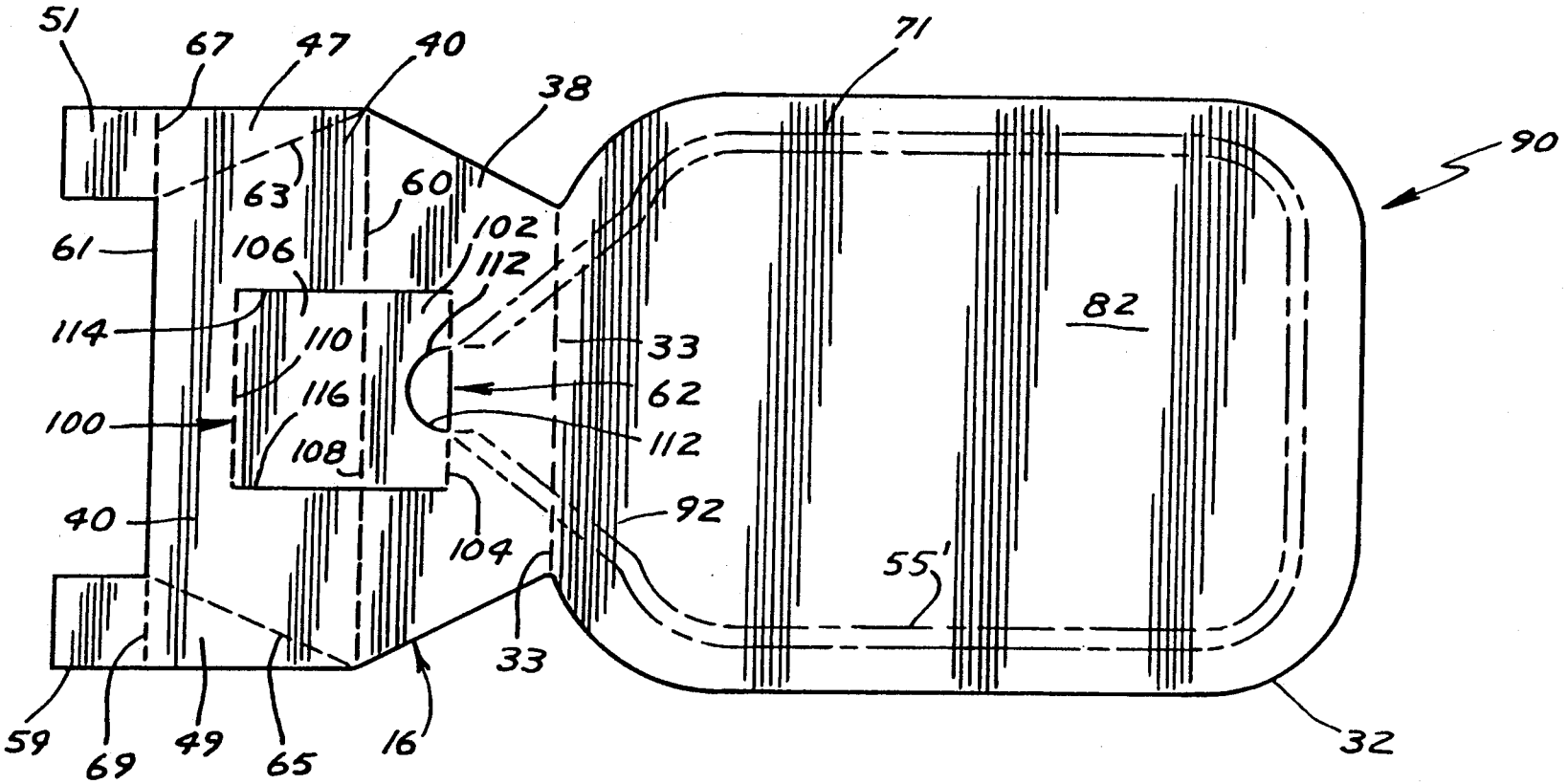
FIG. 7 is a plan view of the inner surfaces of a blank for forming the first embodiment of the present lid closure.

Referring now very briefly to FIG. 7, the lid panel 32 has an inner major surface or face 82 and the reverse cut pattern further comprises a second inner score line 55 on the inner surface 82 proximate the outer score line 71. The term "score line" (or sometimes equivalently "cut score line" in the art) is used herein in a conventional sense to refer to a cut in a surface which penetrates about 50% through the depth of that surface. The term "cut line" is used herein to refer to a cut in a surface which completely penetrates through that surface. Inner score cut line 55 and outer score cut line 71 are offset by about ⅛ to ¼ inch. This offset is exaggerated in FIG. 3 for purposes of illustration. In FIG. 3, it can be seen that each cut line terminates at each end at an angle proximate fold line 33 as part of the pull tab feature described below.

Figure 4:
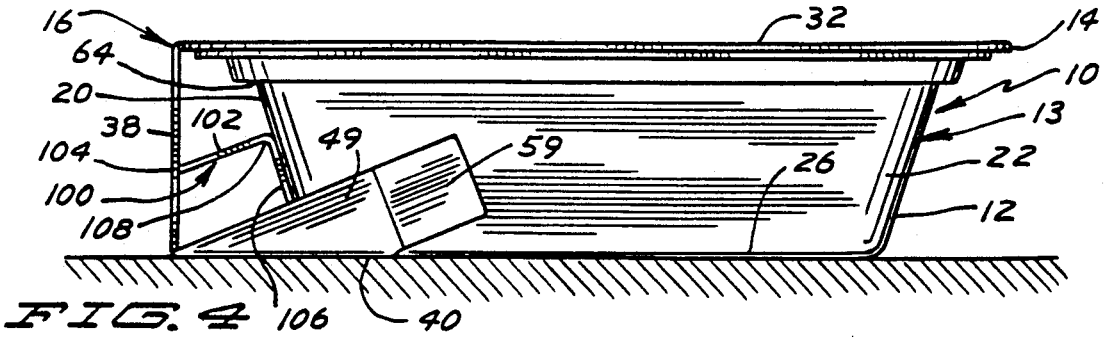
FIG. 4 is a side view of the container.

Reference is now made briefly to FIG. 4 which better shows the stand feature 16 and wherein it can be seen that stand rear panel 40 is in the same plane as the tray rear face 26 which alignment facilitates packing the container 10 horizontally oriented, i.e., on its rear face 26, in cases for distribution to food retailers. FIG. 4 further shows that the stand panel 38 is at right angles to both the lid face panel 32 and rear panel 40 so as to provide stability to the stand feature 16.

Still generally referring to FIG. 4, in the most preferred embodiments, it is an important feature of the present invention that one or more stand support panels are adhesively attached to the tray sidewall 13 rather than exclusively attached to the tray back surface 26 such as support panel 47 being affixed to tray sidewall 22 as depicted. Unfortunately, when conventional hot melt glue is employed, upon microwave heating, stand configurations having flaps attached exclusively to the tray back 26 tend to soften and loosen due to the temperatures reached and then possibly to detach completely. Such detachment of the lid closure 14 structure from the tray 12 is aesthetically undesirable and gives the erroneous but suggestive appearance of poor design or construction.

In FIG. 4 it can also be seen that in this embodiment, optionally the tray 12 can further be fabricated It will be appreciated that the present lid stand can be used with common, simple flange trays (i.e., not having the shoulder 64) as well as the step flange tray depicted herein.

FIG. 4 further depicts an inwardly projecting tray index brace 100. The brace 100 comprises a first panel 102 hingedly attached to the base panel 38 along a common transverse fold line 104 (best seen in FIG. 5) and a second panel 106 hingedly connected at one end to the first panel 102 along a common transverse fold line 108. The second panel 106 in turn is hingedly connected to the rear panel 40 along a transverse common fold line 110 (best seen in FIG. 5) and abuts against the tray bottom minor sidewall 20.

In commercial manufacture, the index brace 100 facilitates the proper placement of the tray 12 relative to the stand 16 so that the lid face 32 and base panel 38 are at true right angles and in turn base panel 38 and rear panel 40 are at true right angles. Unfortunately, minor deviations in the placement of the tray 12 in the stand 16 can in turn cause distortions of these angles. The distorted stands which result exhibit instabilities due to the weight imbalances created. The index brace provides sufficient resistance to movement of the tray 12 so that the tray feed mechanism employed to insert the tray into the stand will use the resistance to signal that the tray 12 has been sufficiently advanced to form properly configured stands. It will be appreciated that once manufacture of the container is completed, and the container is positioned in an upright orientation that the brace 100 provides only modest but nonetheless important additional vertical support to the tray 12.

Figure 5:
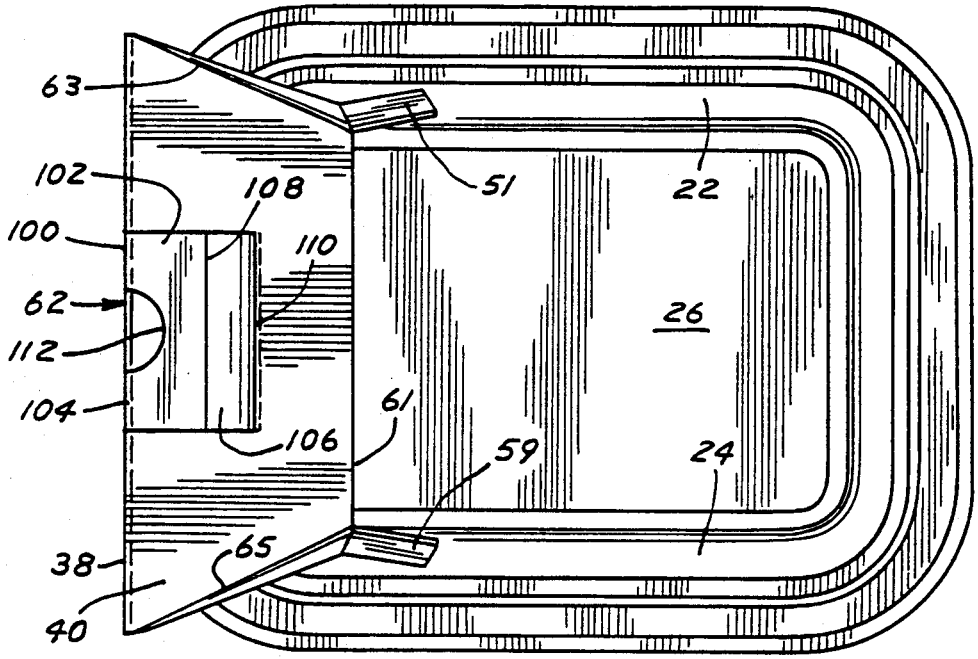
FIG. 5 is a bottom view of the container.

In FIG. 5, it can be seen that the brace panel 100 includes, and the means for controllably opening the container further comprises, a pull tab 62 formed as an integral part of the base 16 including a thumbhole 112. The additional elements comprising the pull tab 62 are described below in connection with FIG. 7.

Referring now once again to FIG. 5, it can be seen that in the most preferred embodiment each support panel 47 and 49 is flared outwardly at about a 15–35° angle relative to a vertical line when standing. That is, fold lines 65 and 63 are at a 15–35° angle relative to vertical. The outward flaring importantly gives both the base panel 38 and the rear panel 40 a trapezoidal shape. This trapezoidal shape of both the base and rear panels is important to providing the superior lateral support benefit herein, especially when lid panel 26 has rounded edges as depicted.

Figure 6:
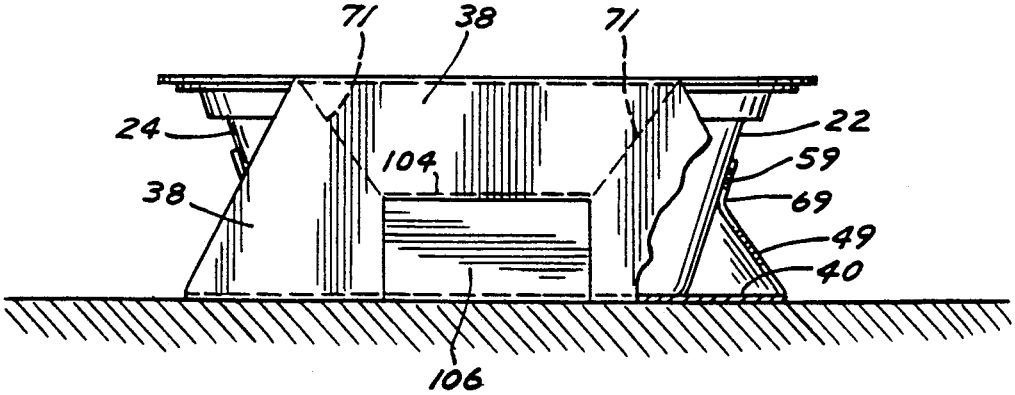
FIG. 6 is an end view of the container.

Reference is now made very briefly to FIG. 6 wherein the stand feature 16, especially base panel 38 and rear panel 40, can be seen to have a width approximately equal to the width of the lid face 32. Of course, other articles within the scope of the present invention can be constructed with wider stand features if desired such as for heavier products or for a container having a substantially wider open face than rear face. FIG. 6 further depicts that outer score line 71 continues in panel 38 to terminate at each end proximate fold line 104. Not shown in FIG. 6 is the continuation of offset score line 55 which is on the inner face of panel 38. (The continuation of score line 55 is best seen in FIG. 7.) Thus, the pull tab feature 62 is defined by thumbhole 112, score line 71, score line 55 (not shown), and optionally, adhesive free area 58 (FIG. 3).

Reference now is made to FIG. 7 which shows a lid blank 90 for forming the lid 14. The blank 90 can be fabricated out of a single piece of conventional packaging material such as bleached kraft, white-coated newsboard, chipboard or other flexible materials well known in the carton art. The blank 90 is shown with the inner surface 82 being uppermost which later becomes the inside of the container 10. Commonly, the outer surface (not shown) is exterior graphics as described above. The blank 90 depicted includes contiguously the cover or major face panel 32 and the stand panel 16. These panels are hingedly connected along the common transverse fold lines 33.

The stand panel 16 itself comprises the base panel 38 and a back or rear panel 40 hingedly articulated or foldably joined along the common transverse fold line 60 as well as the first support panel 47 hingedly articulated along common fold line 63 to the rear panel 40. Panel 40 has a free edge 61. Support panel 47 itself has a stick tab portion 51 hingedly attached along common transverse fold line 67. The stand panel 16 further comprises a second opposed support panel 49 hingedly connected or articulated to the rear panel 40 along common angled fold line 65. Support panel 49 itself has a stick tab portion 59 hingedly attached along a common transverse fold line 69.

FIG. 7 further shows that the major face panel 32 includes the inner peripheral score line 55 on the inner surface 82 except proximate fold line 33 where the score line 55 continues at each end at an angle proximate fold 33.

Also shown is score line 71 which is on the reverse or outer surface of the lid blank 90. The offset of line 71 from 55 is again exaggerated in FIG. 7 for illustration purposes. As noted above, in actual practice, the score lines are offset by only ⅛ to ¼ inch to provide a reverse cut feature.

In FIG. 7, the stand panel 16 includes a combination of cut lines and fold lines which define and provide the brace element 100, including an opposed pair of parallel, longitudinally extending cut lines 114 and 116 each commencing in panel 40 and extending into panel 38, an opposed pair of parallel, transverse fold lines 104 and 110, one of which in panel 40 and the other in panel 38 and an intermediate transverse fold line 108 which is aligned with fold line 60, each of which fold lines extend from cut line 114 to cut line 116. Panel 38 further includes the thumbhole cut line 112 in panel 102 extending from fold line 104. It can be further seen that score lines 71 and 55 extend from panel 32 onto panel 38, each to terminate at an end of the thumbhole 112 to provide in combination with thumbhole 112 a pull tab 28 feature to the stand 16.

In FIG. 7, it is most clearly seen that the flared base and rear panels are defined by fold line 60 being longer in length than either free line 61 or fold line 33.

Figure 8:
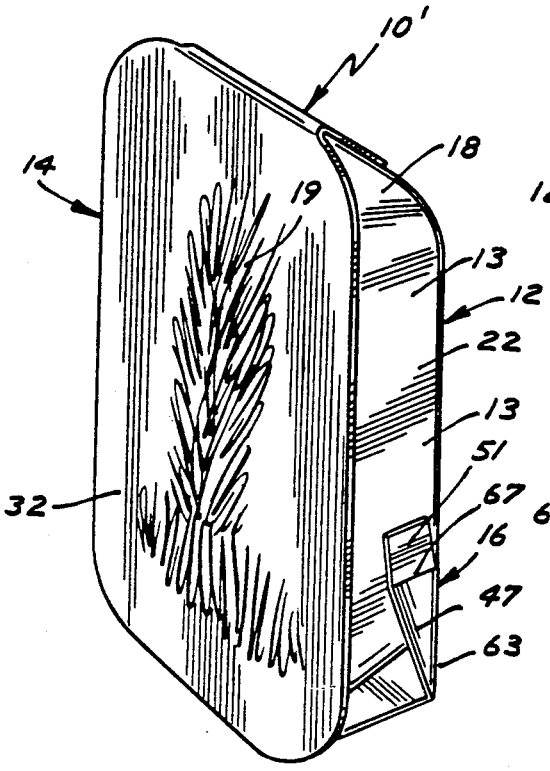
FIG. 8 is a perspective view of the front of a second embodiment of the present container similar to FIG. 1.
Figure 9:
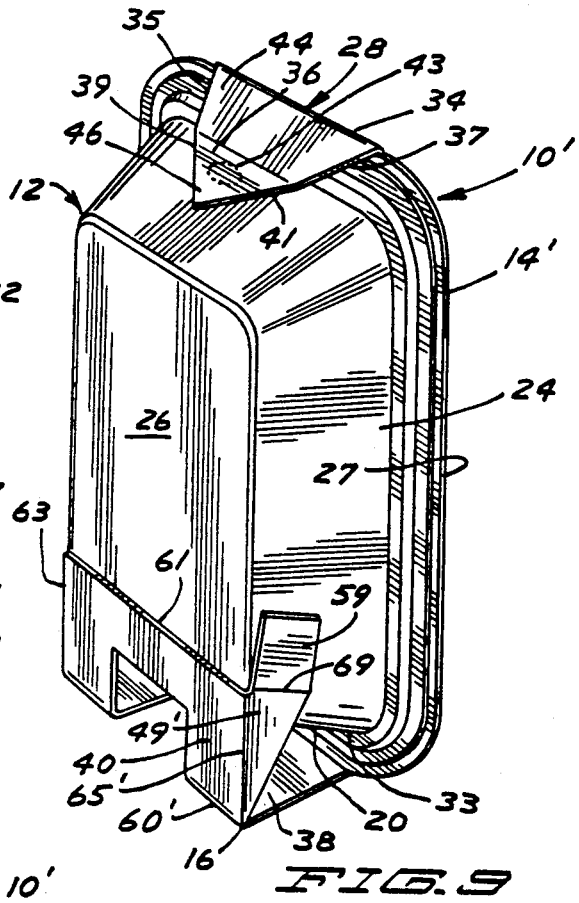
FIG. 9 is a perspective view of the rear of the second embodiment similar to FIG. 2.

Reference is now made generally to FIGS. 8–15 and particularly to FIG. 9, there is seen another embodiment of the container 10' generally similar to the embodiment first depicted in FIG. 1 but differing in two primary respects. The embodiment first depicted in FIG. 8 is shown with an upwardly positioned pull tab 28 in contrast to the pull tab 62 formed in the flared base 16 as depicted in FIGS. 1–7. Second, the flared base 116 shown in FIG. 8 is characterized by a more visually attractive, more squared appearance while nonetheless maintaining the structural strengthening advantages of the present stand configuration. In the description of embodiment 10', elements which are the same as in the preceding description employ the same reference numerals. Elements, however, which are comparable but which are modified are indicated by primed reference numerals.

Still referring to FIG. 8 it can be seen that the container 10' further essentially comprises a means for controllably removing the sealed lid closure 14' from the tray 12, i.e., opening the container 10, which means can include an upwardly positioned pull or removal tab 28. As depicted, the pull tab 28 is hingedly connected to the lid face portion 32 along a transverse fold line 34 and thus is an integral part of the lid 14 and can comprise a first unglued or adhesive free portion 44 conveniently trapezoidal in shape defined by fold line 34 and a fold line 36 and free edges 35 and 37. The pull tab 28 can further include a second portion 46 conveniently triangular in shape defined by fold line 36 and angled free edges 39 and 41 which also, in preferred embodiments, define a tip point 45. Of course, in other embodiments the tip point can be rounded or blunted or the pull tab 28 can be of other useful shapes. The portion 46 is removably adhesively affixed to tray sidewall 18 in a conventional manner such as by a first adhesive means (i.e., employing an adhesive or glue) or by sealing (e.g., the hot melting of a topically applied plastic coating). In the most preferred embodiment, only a limited portion, such as under a circular score line 43 (shown in relief), is affixed to the tray sidewall to facilitate easy opening.

Figure 10:
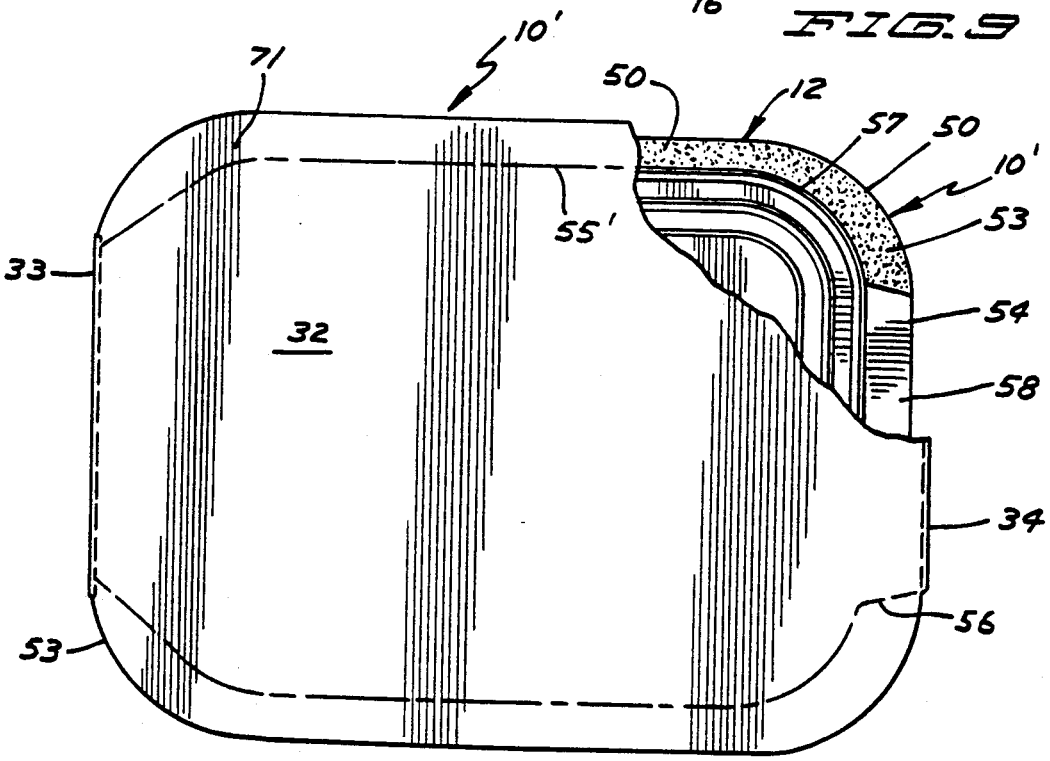
FIG. 10 is a top view of the second container embodiment similar to FIG. 3.
Figure 24:
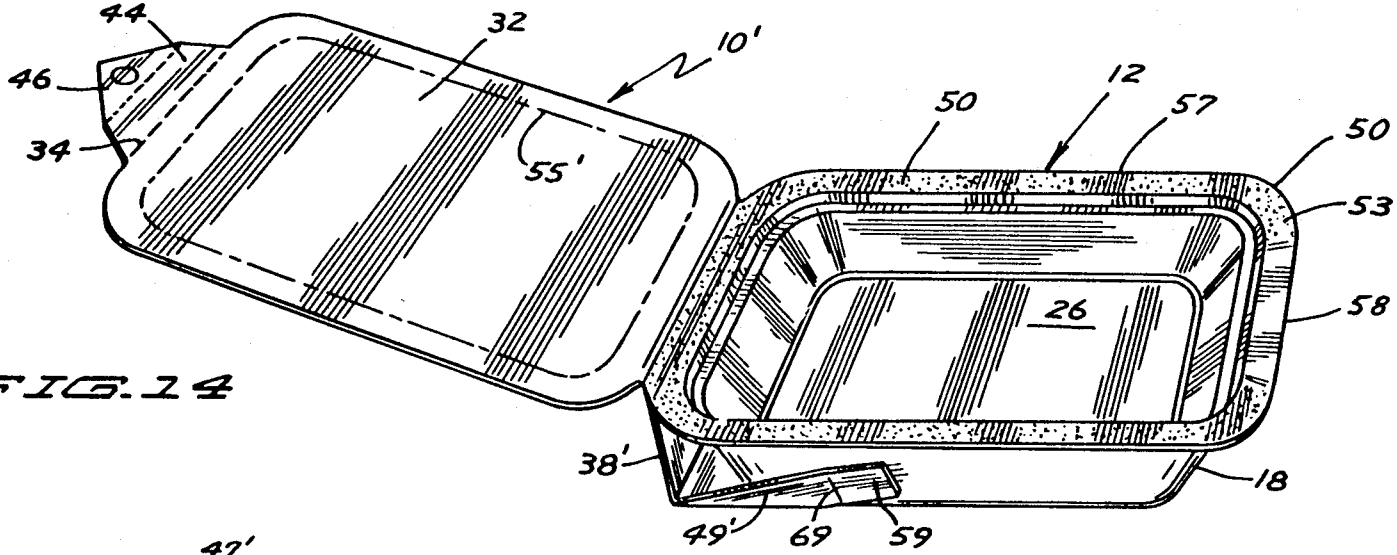
Figure 25:
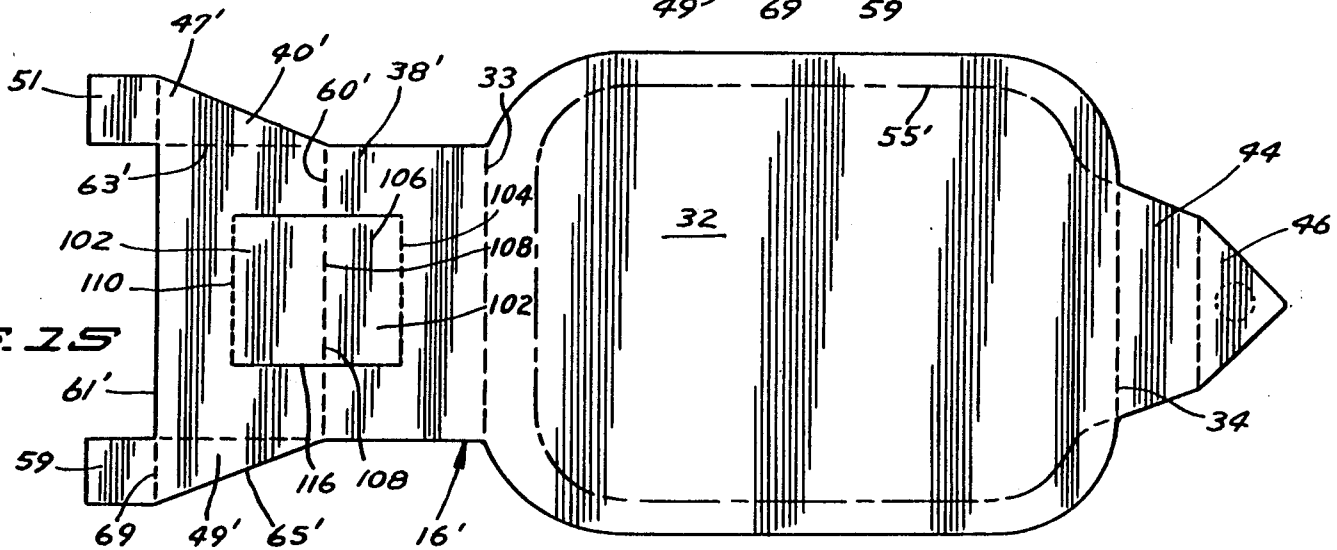

Reference now is made to FIG. 10 which shows a "score cut" pattern on the lid panel 32 rather than the "reverse cut" pattern shown in FIG. 3. The score cut pattern and reverse cut can be used in substitution for one another. The score cut feature comprises a peripheral score line 55' (shown in relief) on the inner surface of the lid's major surface 32 positioned proximately overlaying the inner edge 57 of flange 50 terminating at one end at an angle which extends to the one end of fold line 34 and terminating at its other end at a second angled score line 56 which itself extends to the other end of fold line 34. The term "score line" (or sometimes equivalently "cut score line" in the art) is used in a conventional sense to refer to a cut in a surface which penetrates about 50% through the depth of that surface. The term "cut line" is used herein to refer to a cut in a surface which completely penetrates through that surface. The adhesive free portion 58 desirably extends at least along that portion of flange 50 intermediate the angled score lines. In this embodiment the adhesive free area 58 and the angled cut lines collectively comprise a "score cut" controlled opening feature which facilitates ease of opening of the container 10 by controllably tearing back of the lid 14 and thereby the adhesive bond between lid 14 and the flange 50.

Referring now briefly to FIG. 11, even though the container 10 in this particular embodiment includes the unsealed portion 58, the container 10 is considered to have sufficient seal integrity to provide a tamper proof seal since the unsealed portion 58 is inaccessible due to the overlapping positioning of the lid free portion 44 and panel 46 (not shown).

Reference is now made to FIGS. 12 and 13 which depict more clearly the reduced width of the stand feature. Rather than the trapezoidal base and back panels depicted in embodiment 10, embodiment 10' is characterized by a square or the rectangular shape depicted which is achieved by fold line 38' being equivalent in length to free edge 61. Such a construction provides the increased stability advantages of the more flared stand yet has a more aesthetically pleasing appearance.

Reference now is made to FIG. 14 which shows the container 10' after the lid 14' has been controllably opened or unsealed exposing a lid panel interior major surface 82 of the lid face portion 32. As the lid 14' is controllably unsealed or pulled back to unseal the container 10', the lid 14' generally peels back so the paper releases in a controlled straight line along cut line 55'. It is desirable for the paper to tear in a controlled line for an appealing appearance for the consumer. The container 10' depicted in FIG. 14 is shown without a charge of food. However, if the container 10' does contain a food portion or a food portion is subsequently added to the container 10', then the food containing container 10' can then be heated such as in a microwave oven for an appropriate time. The lid 14' is articulated back to a closed but unsealed position (not shown) along fold 84. In this position, the lid 14' acts as a cover or splatter guard during the microwave heating step. Conveniently, in its unsealed condition, the lid 14' allows for steam escape during microwave heating of the foodstuff.

In FIG. 14, it can be seen that in this particular embodiment as the lid 14' is removed and unsealed, the lid 14' completely severs along the outer and inner peripheral score lines 55 leaving a lid peripheral residue piece 86 still adhesively attached to the flange 50 except over the adhesive free area 58 and forming peripheral free edges 88 and 89 on lid face 32.

In certain embodiments not illustrated but nonetheless well within the scope of the present invention, the package 10 does not comprise an adhesive-free portion 58, but rather, the flange 50 has the adhesive means 52 substantially completely over its surface area to provide a seal-proof closure. Such a construction is desired where the container is used, for example, to contain an aseptically processed foodstuff such as a high water activity material such as a frozen stew or meal entree or when the package contains powders or dried foods that are directly in contact with the package, i.e., when you don't have pouches of food inside the package. Those embodiments wherein the container 10 does comprise the glue free portion 58 might include, for example, wherein the container 10 is used to house one or more packets in nested trays for packaged dry food items, (e.g., a first packet of seasoning dried rice and an associated tray and a second packet of aseptic meat sauce).

Reference is now made to FIG. 15 which shows a lid blank 90' for forming the lid 14'. The blank 90' can be fabricated out of a single piece of conventional packaging material described in detail above. The blank 90' is shown with the inner surface 82 being uppermost which later becomes the inside of the container 10'. The blank 90' depicted includes contiguously the cover or major face panel 32 and the stand panel 16'. These panels are hingedly connected along the common transverse fold lines 33.

The stand panel 16' itself comprises the base panel 38' and a back or rear panel 40' hingedly articulated foldably joined along the common transverse fold line 60' as well as the first support panel 47' hingedly articulated along common fold line 63' to the rear panel 40'. Panel 40' has a free edge 61'. Support panel 47' itself has a stick tab portion 51 hingedly attached along common transverse fold line 67. The stand panel 16' further comprises a second opposed support panel 49' hingedly connected or articulated to the rear panel 40' along common fold line 65'. Support panel 49' itself has a stick tab portion 59 hingedly attached along a common transverse fold line 69. FIG. 15 further shows that the major face panel 32 includes the inner peripheral score line 55'.

In FIG. 15, the stand panel 16' includes a combination of cut lines and fold lines which define and provide the brace element 100, including an opposed pair of parallel, longitudinally extending cut lines 114 and 116 each commencing in panel 40' and extending into panel 38', an opposed pair of parallel, transverse fold lines 104 and 110, one of which in panel 40' and the other in panel 38' and an intermediate transverse fold line 108 which is aligned with fold line 60', each of which fold lines extend from cut line 114 to cut line 116. In FIG. 15, it is most clearly seen that the flared base and rear panels are defined by fold line 60 being equal in length to free line 61' or fold line 33.

Industrial Applicability

The present article finds particular suitability for use in the paper packaging industry and especially for the packaged foods trade. The present containers find utility for the packaging of both frozen and shelf stable food items. It will be appreciated, however, that the present containers can also be used as a package for a wide variety of packaged items which are presently packaged with an outer carton. In particular, the present containers are especially useful to support heavier packaged items.

It should be further understood that the foregoing description of the invention is intended merely to be illustrative thereof and that the invention is not confined to the construction and arrangement of parts herein illustrated and described, but embraces all such modified forms thereof as come within the scope of the following claims.

What is claimed is:

1. A container for a packaged item adapted to stand on its sidewall in a vertically aligned position on a shelf thereby allowing presentation of a major face to the consumer without requiring an outer carton and which subsequent to opening can be partially reclosed, comprising:

A. a tray for supporting the item having a rear major surface, an open major face opposite the rear major surface and a continuous sidewall having a top edge surface surrounding the open face;

B. a lid closure fabricated from a single flexible material piece having a lid panel having an outside and inside major surface and upper and lower ends, said lid panel overlaying the open face and extending over the flange, said lid panel being removably adhesively secured to the flange;

(1) means for supporting the tray in the vertically aligned position hingedly connected to the lid panel along a first transverse fold line proximate the lower end, comprising:

(a) a base panel foldably adjoined to the lid panel at substantially a right angle to the tray along the first transverse fold line at one end having an opposed parallel end, (b) a rear panel foldably adjoined at one end to the second end of the base panel along a second, common transverse fold line, and wherein the length of the second common transverse fold line is at least equal to the length of the first transverse fold line, said rear panel having a second opposed parallel free end abutting the rear major surface, a first and second opposed non-parallel ends, a first support panel foldably adjoined at one end to the first non-parallel end of the rear panel having a stick tab portion at least a portion of which is adhesively secured to a portion of the tray sidewall, a second support panel foldably adjoined at one end to the second non-parallel end of the rear panel having at least a portion of which is adhesively secured to a portion of the tray sidewall, (c) tray index brace comprising a tray panel abutting the tray sidewall, said tray panel being defined by an opposed pair of first and second laterally extending cut lines in the rear panel extending inwardly from the second, common transverse fold line wherein each cut line terminates at one end at a first minor transverse fold line in the rear panel extending between the first and second cut lines, said brace further comprising a spacing panel intermediate the tray sidewall and the base panel, said spacing panel being defined by a second pair of opposed laterally extending cut lines in the base panel extending inwardly from the third common transverse fold line and terminating at the second end at a second minor transverse fold line in the rear panel, said rear panel fold line extending between the first and second cut lines, (2) adhesive means for releasably attaching the lid panel;

(3) a means for controllably opening the lid closure.

2. The container of claim 1 wherein the rear panel is in the plane of the tray rear face and at a right angle to the base panel, and wherein the length of the second common fold line is longer than the length of the first common fold line thereby defining a trapezoidally shaped base panel.

3. The container of claim 2 wherein the first transverse fold line is proximate the outer edge of the tray flange and the lower end of the face panel, and wherein the means for controllably opening the lid closure includes a pull tab hingedly connected to the lid panel along a fourth common transverse fold line.

4. The container of claim 3 wherein the means for controllably opening the lid closure further includes a first peripheral score line on the inside major surface of the lid face panel proximate the inner edge of the tray flange.

5. The container of claim 4 wherein the pull tab is positioned at the upper end of the lid face panel.

6. The container of claim 5 wherein the pull tab has a portion removably adhesively attached to the tray sidewall.

7. The container of claim 6 wherein the means for controllably opening the lid closure further includes an adhesive free flange portion proximate the pull tab, and a second peripheral score line on the outer surface of the outside major surface of the lid face panel substantially conforming in position to the first peripheral score line and offset thereto about ⅛ to ¼ inch.

8. The container of claim 1, 2, 3, 4, 5, 6, or 7 wherein the tray has a continuously curved sidewall.

9. The container of claim 1, 2, 3, 4, 5, or 6 wherein the tray has a sidewall having at least a portion which is straight.

10. The container of claim 7 wherein the tray has a sidewall having at least a portion of which is straight.

11. The container of claim 10 wherein the tray sidewall has at least two spaced apart straight portions, wherein the first stick tab is adhesively affixed to the first straight sidewall portion and the second stick tab is adhesively affixed to the second straight portion.

12. The container of claim 11 wherein the tray is fabricated from pressed paperboard.

13. A one-piece package blank for a package lid useful as a lid closure for an open faced tray having a sidewall fabricated with a peripheral flange and which supports the tray in a vertical position, comprising:

A. a first major face panel for overlaying the tray open face having inner and outer major surfaces and first and second ends;

B. a stand tab hingedly connected to the first end of the face panel along a first common transverse fold line, said stand tab comprising a base panel hingedly connected to the face panel along the first transverse fold line, a rear panel hingedly connected to the base panel along a second transverse common fold line, at least one support panel hingedly connected to the rear panel along a third common fold line; and a tray index brace defined by an opposed pair of first and second laterally extending cut lines in the base panel and rear panels extending inwardly from the second, common transverse fold line and each cut line terminating at one end at a first minor transverse fold line in the base panel extending between the first and second cut lines and terminating at the second end at a second minor transverse fold line in the rear panel, said second common fold line extending between the first and second cut lines:

C. a pull tab hingedly connected to the second end of the face panel along a fourth, transverse common fold line.

14. The package blank of claim 13 wherein the face panel has a peripheral score line on the inner major surface.

15. The package blank of claim 14 wherein the third common fold line is a transverse fold line.

16. The package blank of claim 15 wherein the rear panel has an opposed first pair of lateral support flaps inwardly foldable hingedly connected along first and second longitudinally extending fold lines.

17. The package blank of claim 16 wherein the base panel has an opposed second pair of lateral support flaps inwardly foldable hingedly connected along a third and fourth longitudinally extending fold line.

18. A one-piece package blank for a package lid useful as a lid closure for an open faced tray having a sidewall fabricated with a peripheral flange and which supports the tray in a vertical position, comprising:

A. a first major face panel for overlaying the tray open face having inner and outer major surfaces and first and second ends;

B. a stand tab hingedly connected to the first end of the face panel along a first common transverse fold line, said stand tab comprising a base panel hingedly connected to the face panel along the first transverse fold line, a rear panel hingedly connected to the base panel along a second common fold line, at least one support panel hingedly connected to the rear panel along a third common fold line, a tray index brace defined by an opposed pair of first and second laterally extending cut lines in the base panel and rear panels extending inwardly from the second, common transverse fold line and each cut line terminating at one end at a first minor transverse fold line in the base panel extending between the first and second cut lines and terminating at the second end at a second minor transverse fold line in the rear panel, said second common fold line extending between the first and second cut lines, and C. a pull tab hingedly connected to the first end of the face panel along a fourth transverse common fold line.

19. The package blank of claim 18 wherein the face panel has a peripheral score line on the inner major surface.

20. The package blank of claim 19 wherein the third common fold line is a transverse fold line.

21. The package blank of claim 20 wherein the rear panel has an opposed first pair of lateral support flaps inwardly foldable hingedly connected along first and second longitudinally extending fold lines.

22. The package blank of claim 21 wherein the base panel has an opposed second pair of lateral support flaps inwardly foldable hingedly connected along a third and fourth longitudinally extending fold line.

* * * * *

UNITED STATES PATENT AND TRADEMARK OFFICE

CERTIFICATE OF CORRECTION

PATENT NO. : 5,011,006

DATED : April 30, 1991

INVENTOR(S) : David S. Anderson

It is certified that error appears in the above-identified patent and that said Letters Patent is hereby corrected as shown below:

Title Page:
Abstract, last line; "stands" should be -- stand --.

Col. 1, line 43; "most" should be -- almost --.

Col. 2, line 29; after "not" insert -- directly add vertical support but facilitates the proper --.

Col. 4, line 39; "corners" should be -- corners. --

Col. 5, line 37; after "fabricated" insert -- with a step flange defining an inner peripheral shoulder 64. --

Col. 6, line 42; after "is" insert -- white-coated or clay-coated and displays the carton's --

Col. 12, line 16; "lines:" should be -- lines; --

Signed and Sealed this

Twentieth Day of October, 1992

*Attest:*

DOUGLAS B. COMER

*Attesting Officer*

*Acting Commissioner of Patents and Trademarks*